US005403691A

United States Patent [19]

Oshiba et al.

[11] Patent Number: 5,403,691

[45] Date of Patent: Apr. 4, 1995

[54] METHOD FOR PREPARING AN ELECTROPHOTOGRAPHIC PHOTORECEPTOR

[75] Inventors: Takeo Oshiba; Yoshihiko Etoh; Yoshiaki Takei, all of Hachioji, Japan

[73] Assignee: Konica Corporation, Japan

[21] Appl. No.: 50,512

[22] Filed: Apr. 20, 1993

[30] Foreign Application Priority Data

Apr. 22, 1992 [JP] Japan ..... 4-102997

[51] Int. Cl.[6] ..... G03G 5/05

[52] U.S. Cl. ..... 430/134; 430/133; 430/72

[58] Field of Search ..... 430/134, 71, 72, 133

[56] References Cited

U.S. PATENT DOCUMENTS

| | | | |
|---|---|---|---|
| 4,612,271 | 9/1986 | Malino et al. | 430/72 |
| 4,895,782 | 1/1990 | Koyama et al. | 430/135 |
| 4,939,058 | 7/1990 | Shibata et al. | 430/72 |
| 5,075,189 | 12/1991 | Ichino et al. | 430/58 |
| 5,114,815 | 5/1992 | Oda et al. | 430/96 |

*Primary Examiner*—Christopher D. Rodee

*Attorney, Agent, or Firm*—Jordan B. Bierman

[57] ABSTRACT

Disclosed is a method for preparing an electrophotographic photoreceptor comprising the steps of:

(a) preparing a dispersion solution comprising a carrier generation material, a binder resin and an organic solvent; and (b) coating said dispersion solution on a conductive support; wherein said carrier generation material is a fluorenone type bisazo pigment represented by Formula $F_1$, and main component of said organic solvent is selected from the group consisting of a ketone type solvent, an ester type solvent and an alcohol type each having a branched alkyl group:

Formula $F_1$ wherein $X_1$, $X_2$, p, q, and A, are defined as in the Specification.

5 Claims, 1 Drawing Sheet

METHOD FOR PREPARING AN ELECTROPHOTOGRAPHIC PHOTORECEPTOR

FIELD OF THE INVENTION

The present invention relates to an electrophotographic photoreceptor, and more particularly to solution stability of a coating for a photosensitive layer.

BACKGROUND OF THE INVENTION

Electrophotographic photoreceptors employing inorganic photoconductive substances such as selenium, cadmium sulfide and zinc oxide have been replaced rapidly by photoreceptors (OPC) employing organic photoconductive substances. The reason for this is that organic photoconductive substances can offer various materials through combination of synthetic substances and synthesis conditions and thereby can offer a wide range of selection so that desired photoreceptors meeting the purpose can be prepared easily.

In OPCs, the function-separation type wherein a material bearing a function to generate carriers and a material bearing a function to convey carriers are different each other, the range of selection of materials has further been broadened, resulting in expectation of improvement in electrophotographic properties such as charging ability, sensitivity and durability.

As methods for forming a carrier generated layer (CGL) in a photoreceptor, gaseous phase deposition methods such as a vacuum evaporation method, a spattering method and CVD as well as coating methods such as dipping, spraying, blade and roll methods are employed.

Among them, when forming through a coating method, coatings for a carrier generated layer (CGL solution) wherein an organic photoconductive pigment (carrier generated material: CGM) is dispersed in an organic solvent are employed in many cases.

Properties required for the above-mentioned CGL solution,

—dispersion property of CGM is good

—can be coated uniformly without defects

—physical properties of the solution such as fluidity and particle size distribution in manufacturing of a photoreceptor is manufactured and electrophotographic properties of photoreceptor are stable —durable against repeated use —no change in properties occurs after being stocked for a long time On the other hand, as CGMs used for the above-mentioned function-separation type photoreceptors, various organic dyes or organic pigments have been proposed. For example, multi-ring quinone pigments, pyrylium dyes, perylene pigments, indigoid pigments, phthalocyanine pigments and azo pigments have been put into practical use.

In the above-mentioned CGMs, enhancement of sensitivity can be contrived by providing specific coagulation structure or crystal structure in the course of setting their manufacturing conditions. However, it is difficult to set conditions of dispersion for keeping the above-mentioned structures after CGMs are processed to dispersion solutions. Accordingly, those satisfying all properties such as charging ability, sensitivity and repetitive property have not been obtained. Especially, in terms of sensitivity, further enhancement of sensitivity and stability are demanded.

As a technology coping with the above-mentioned demand, one wherein a specific titanyl type phthalocyanine is dispersed into a specific organic solvent is disclosed in Japanese Patent Publication Open to Public Inspection (hereinafter, referred to as Japanese Patent O.P.I. Publication) No. 33859/1991.

However, improvement caused by the consumption manner of the solution in mass production of a photoreceptor employing a dispersion solution containing an azo pigment as a CGM and deterioration in a CGL solution in terms of change in crystal shape, absorbancy spectra and photo-sensitivity is not yet enough. In addition, when the life of solution is short as mentioned above, replacement of dispersion solution becomes frequent, causing high cost. Therefore, improvement in such issues is also demanded.

SUMMARY OF THE INVENTION

An object of the present invention is to inhibit deterioration in solution caused by the consumption manner of a CGL solution.

Another object of the present invention is to provide a CGL solution keeping stable properties even after being stocked for a long period of time.

Another object of the present invention is to provide an electrophotographic photoreceptor excellent in stability in charging ability, sensitivity and repetitive property.

Explanation of symbols

Figure 1:
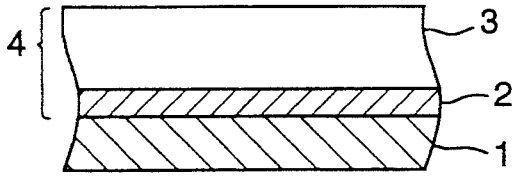
FIGS. 1(*a*) through 1(*f*) are cross-sectional views of the layer construction of the electrophotographic photoreceptors used as examples of the invention.
Figure 1:
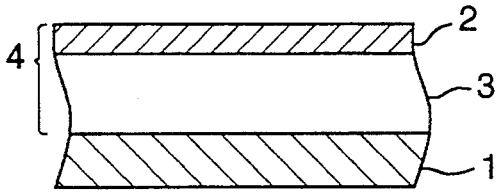
Figure 1:
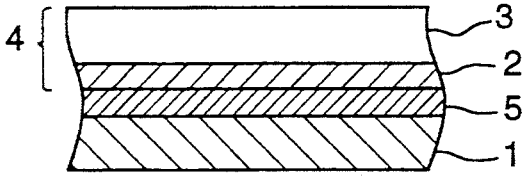
Figure 1:
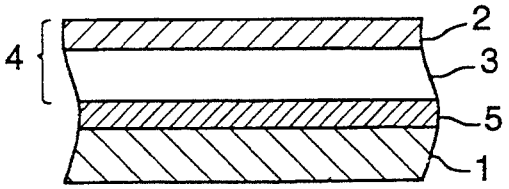
Figure 1:
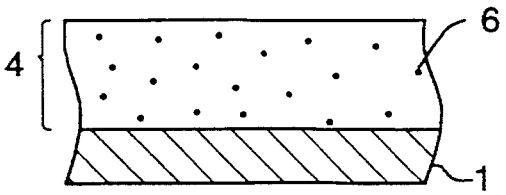
Figure 1:
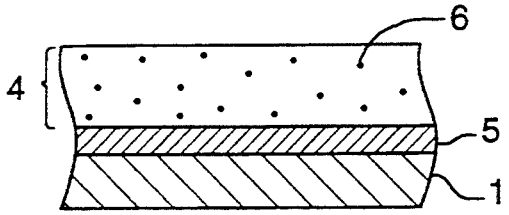

1. Electroconductive support
2. Carrier generated layer
3. Carrier transport layer
4. Photoreceptive layer
5. Intermediate layer
6. Mono layer photoreceptive layer

DETAILED DESCRIPTION OF THE PREFERRED EMBODIMENT

The purpose of the present invention mentioned above is attained by a method for preparing an electrophotographic photoreceptor comprising a step for coating on a conductive support a dispersion solution in which a carrier generating substance composed of an organic photoconductive material is dispersed in an organic solvent to form a photosensitive layer wherein said dispersion solution is a solution in which a fluorenone type disazo pigment is dispersed in an organic solvent containing as the main component at least one kind selected from the group consisting of a ketone type solvent, an ester and an alcohol type solvent each having a branched alkyl group and an electrophotographic photoreceptor formed by said preparing method.

The above-mentioned fluorenone type disazo pigments are represented by formulas $F_1$ and $F_1$-1 illustrated by the above-mentioned chemicals 1 and their components are provided as mentioned above.

Incidentally, in the embodiment of the present invention, the above-mentioned solvent is preferably methylisopropylketone. In addition, the above-mentioned dispersion solution preferably contains polyvinyl butyral as a binder resin. Furthermore, the above-mentioned dispersion solution is preferably coated on an intermediate layer employing polyamide type resin.

The layer structures of photoreceptor formed by the preparation method in the present invention are shown in (1) to (6) of FIG. 1. In the layer structures, photoreceptor layers may either be a single layer or a laminated layer.

In (1) and (2) of FIG. 1, the numeral 1 represents an electroconductive support, 2 represents a carrier generated layer (CGL) containing fluorenone type disazo pigment, 3 represents a carrier transport layer (CTL) containing a carrier transport material (CTM) described later, 4 represents a light-sensitive layer composed of the above-mentioned CGL and CTL. In addition, in (3) and (4) of FIG. 1, layers 1 through 4 are the same as above, and 5 is an intermediate layer such as an adhesive layer or a barrier layer. Furthermore, (5) and (6) of FIG. 1 show the case where photoreceptor layers are single layers, wherein 1, 4 and 5 are the same as above and 6 is a photoreceptor layer containing CGM and CTM dispersedly.

The layer structure in the present invention has most preferably 2 layers of CGL and CTL. In addition, layer 2 may contain a CTM. Furthermore, a protective layer may be provided as the outermost layer.

In an ordinary method for preparing a CGL solution, a CGM is prepared to fine grain in a dispersion medium by means of a ball mill or a sand grinder and then mixed with a binder for dispersion if necessary to prepare a dispersion solution. The present invention can employ this method.

As a coating method of a of CGL solution, coating methods such as dipping, spray, blade and roll may be employed arbitrarily.

The thickness of CGL formed in the above-mentioned manner is preferably 0.01 to 5 μm. It is more preferably 0.05 to 3 μm.

Hereunder, we will illustrate practical examples of fluorenone type disazo pigments employed in the present invention. However, it should be understood that the present invention is by no means restricted to such specific examples.

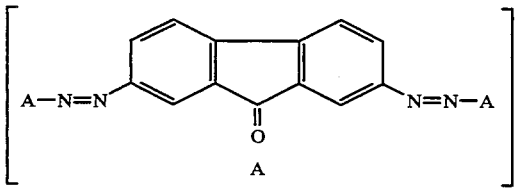

Sample No.

F-1

-continued

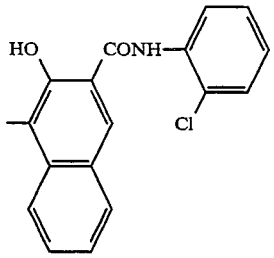

F-2

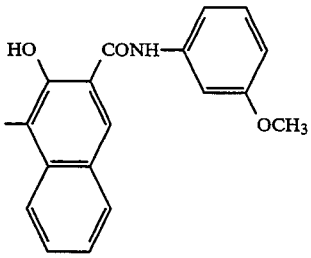

F-3

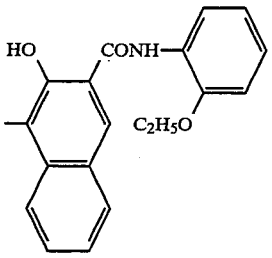

F-4

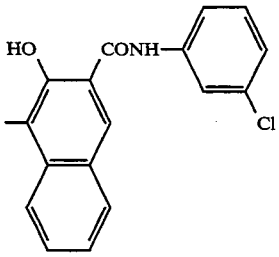

F-5

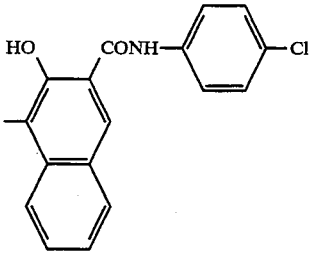

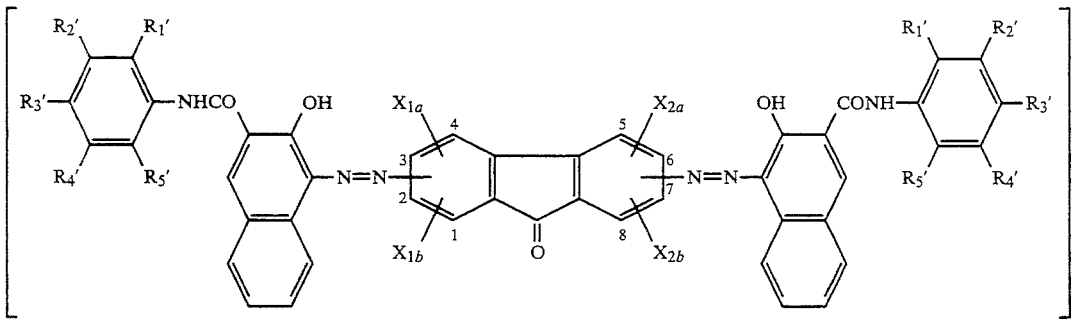

| Compound number | Position of substituting an azo group | $X_1a$ | $X_1b$ | $X_2a$ | $X_2b$ | $R_1'$ | $R_2'$ | $R_3'$ | $R_4'$ | $R_5'$ |
|---|---|---|---|---|---|---|---|---|---|---|
| F-6 | 2,7-position | 4-F | H | H | H | H | $CF_3$ | H | H | H |
| F-7 | 2,7-position | 4-F | H | H | H | $CF_3$ | H | H | $CF_3$ | H |
| F-8 | 2,7-position | 3-F | H | 5-F | H | $CF_3$ | H | H | H | H |
| F-9 | 2,7-position | 3-F | H | 6-OH | H | H | $CF_3$ | H | H | H |
| F-10 | 2,7-position | 4-Cl | H | H | H | H | $CF_3$ | Cl | H | H |
| $F_1$-11 | 2,7-position | 3-Cl | H | 6-Cl | H | H | $CF_3$ | H | H | H |
| $F_1$-12 | 2,7-position | 4-Br | H | H | H | H | $CF_3$ | H | H | H |
| $F_1$-13 | 2,7-position | 4-Br | H | 5-Br | H | H | H | $CF_3$ | H | H |
| $F_1$-14 | 2,7-position | 1-Br | 3-Br | 6-Br | H | H | $CF_3$ | H | H | H |
| $F_1$-15 | 2,7-position | 4-I | H | H | H | H | $CF_3$ | H | H | H |
| $F_1$-16 | 2,7-position | 4-I | H | H | H | $CF_3$ | H | H | $CF_3$ | H |
| $F_1$-17 | 2,6-position | 4-Cl | H | H | H | H | $CF_3$ | H | H | H |
| $F_1$-18 | 3,6-position | 2-Cl | H | 7-Cl | H | H | $CF_3$ | H | H | H |
| $F_1$-19 | 3,6-position | 4-Br | H | H | H | H | H | $CF_3$ | H | H |
| $F_1$-20 | 3,6-position | 4-I | H | H | H | Cl | H | H | $CF_3$ | H |
| $F_1$-21 | 2,5-position | 3-Br | H | H | H | H | $CF_3$ | H | H | H |
| $F_1$-22 | 1,8-position | 3-Cl | H | H | H | H | $CF_3$ | H | H | H |
| $F_1$-23 | 2,7-position | 4-Br | H | H | H | H | H | H | $CF_3$ | H |
| $F_1$-24 | 2,7-position | 4-I | H | H | H | H | $CF_3$ | H | H | Cl |

In the present invention, fluorenone type disazo pigment represented by the above-mentioned formula $F_1$ are synthesized easily by well known methods. For example, they are synthesized by a method disclosed in Japanese Patent O.P.I. Publication No. 20877/1990.

In the present invention, as practical examples of solvents employed for preparing the above-mentioned CGL solution, the following are cited:

(1) Ketone type solvents having a branched alkyl group
Methylisopropylketone
Methylisobutylketone
Methyl tertiary butylketone
4-methoxy-4-methyl-2pentanone (2) Ester type solvents having a branched alkyl group
Isopropyl acetate
Tertiary butyl acetate
Isobutyl acetate
Secondary butyl acetate (3) Alcohol type solvents having a branched alkyl group
Isopropyl alcohol
Isobutyl alcohol
Secondary butyl alcohol
Tertiary butyl alcohol The above-mentioned solvents can be used singly or two or more of them can be used as a mixture.

Of them, methylisopropylketone (MIPK) is especially preferably used.

In addition, the following resins can be cited as examples of CGL binders:

(1) Polyester
(2) Methacrylic resin
(3) Acrylic resin
(4) Polyvinyl chloride
(5) Polyvinylidene chloride
(6) Polystyrene
(7) Polyvinylacetate
(8) Styrene copolymer resin (for example, styrene-butadiene copolymer and styrene-methacrylic acid methyl copolymer)
(9) Acrylonitrile type copolymer resin (for example, vinylidene chloride-acrylonitrile copolymer)
(10) Vinyl chloride-vinyl acetate copolymer
(11) Vinyl chloride-vinyl acetate-maleic acid anhydride copolymer
(12) Silicone resin
(13) Silicone-alkyd resin
(14) Phenol resin (for example, phenol-formaldehyde resin and crezolformaldehyde resin)
(15) Styrene-alkyd resin
(16) Poly-N-vinylcarbazole
(17) Polyvinyl butyral
(18) Polyvinyl formal
(19) Polyhydroxystyrene
(20) Polycarbonate resin The above-mentioned binders may be used singly or 2 or more of them can be used in combination.

Polyvinyl butyral is especially preferably used.

Polyvinyl butyral resins capable of being contained in the above-mentioned CGL solution have a repetitive unit represented by the following formula V:

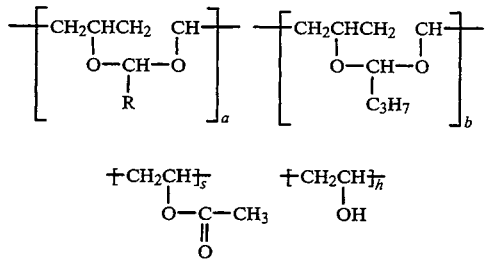

wherein R represents a hydrogen atom, a methyl atom and an ethyl atom; a, b, s and h represents a degree of polymerization.

Generally, the physical and chemical properties of polyvinyl butyral resins vary depending upon the constitution thereof. In addition, mechanical properties and solution viscosity vary depending upon their degree of polymerization.

Polyvinyl butyral used in a binder for a CGL in the present invention is a copolymer resin wherein a polyvinyl alcohol resin is prepared by saponifying vinylpolyacetate resin in the manner that a vinyl acetate portion (a structural unit to which the index for the degree of polymerization s is affixed in formula V) and, under conditions a vinyl alcohol structural unit to which the index for the degree of polymerization h is affixed is remained, an acetal structural unit to which the index for degree of polymerization s is affixed is formed employing at least one of formaldehyde, acetaldehyde and propylaldehyde and butyral structural unit is formed to which the index for polymerization degree b is affixed is formed employing butylaldehyde. The degree of butyralization is preferably 50 mol % or more and (a+b) is preferably 50 mol % or more. In addition, as the degree of polymerization, 1000 or more is required. The upper limit is 10000, and preferably 5000.

An carrier transport layer in the present invention is formed by coating a solution wherein an carrier transport material is dissolved into an appropriate solvent or a solution wherein a binder resin is mixed and dissolved into the above-mentioned solution if necessary.

As a binder, the above-mentioned resins can be employed as they are.

As solvents, for example, hydrocarbons such as hexane, benzene, toluene and xylene, halogen hydrocarbons such as methylenechloride, methylenebromide, 1,2-dichloroethane, syntetrachloroethane, cis-1,2-dichloroethylene, 1,1,2-trichloroethane, 1,1,1-trichloroethane, 1,2-dichloropropane, chloroform, bromoform and chlorobenzene, ketones such as acetone, methylethylketone and cyclohexanone, esters such as ethyl acetate and butyl acetate, alcohols such as methanol, ethanol, propanol, butanol, cyclohexanol, heptanol, ethyleneglycol, methyl cellusolve, ethyl cellosolve and cellosolve acetate and their derivatives, tetrahydrofuran, 1,4-dioxane, furan and furfural, acetals, amines such as pyridine, butylamine, diethylamine, ethylenediamine and isopropanolamine, nitrogen compounds including amides such as N,N-dimethylformamide, fatty acid, phenols and sulfur and phosphor compounds such as carbon disulfide and triethyl phosphate.

In a CTL formed in the manner described as above, a CTM is preferably 20 to 200 part per 100 parts by weight of a binder resin in a CTL, and more preferably 30 to 150 parts by weight.

In addition, the thickness of CTL formed is preferably 5 to 60 μm and more preferably 10 to 40 μm.

There is no limitation in the above-mentioned CTM employed in the present invention. However, the preferable are oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, amine derivatives, oxazolone derivatives, benzothiazole derivatives, benzoimidazole derivatives, quinazoline derivatives, benzofuran derivatives, acrydine derivatives, phenadine derivatives, aminostilbene derivatives, poly-N-vinylcarbazole, poly-1-vinylpyrene and poly-9-vinylanthracene.

As a CTM employed in the present invention, those excellent in ability for transporting holes being generated when light is irradiated to the side of the surface of photoreceptor or to the support side and are extremely suitable for the combination with the above-mentioned fluorenonedisazo pigments are employed. The preferable CTMs are those represented by the following formulas T-1 and T-2.

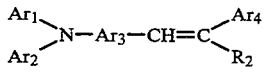

Formula T-1

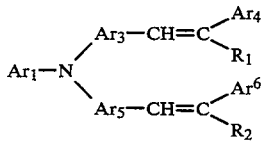

Formula T-2

In formulas T-1 and T-2, $Ar_1$, $Ar_2$, $Ar_4$ and $Ar_6$ respectively represent a substituted or unsubstituted aryl group. They are preferably substituted or unsubstituted phenyl groups or substituted or unsubstituted naphthyl groups. $R_1$ and $R_2$ respectively represent a hydrogen atom, a substituted or unsubstituted alkyl group and a substituted or unsubstituted aryl group. They are preferably hydrogen atoms, alkyl groups having 1 to 8 carbon atoms, substituted or unsubstituted phenyl groups or substituted or unsubstituted naphthyl groups. $Ar_3$ and $Ar_5$ respectively represent substituted or unsubstituted arylene groups. They are preferably substituted or unsubstituted phenylene groups or substituted or unsubstituted naphtylene groups.

Practical examples of the above-mentioned compounds are shown below, however, it should be understood that the present invention is by no means restricted to such specific examples.

A-(1)
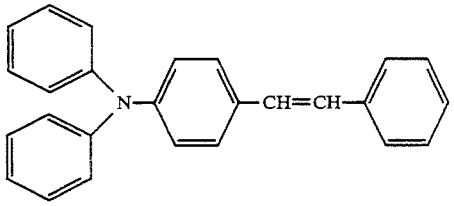
A-(2)
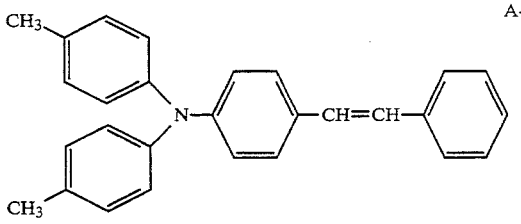
A-(3)
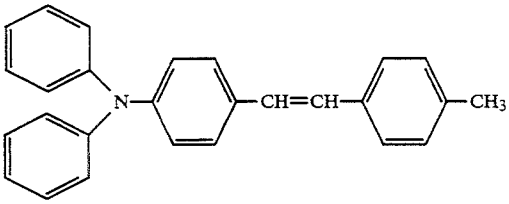
A-(4)
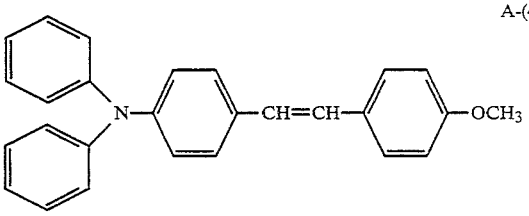
A-(5)
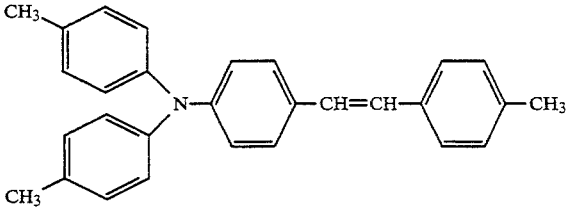
A-(6)
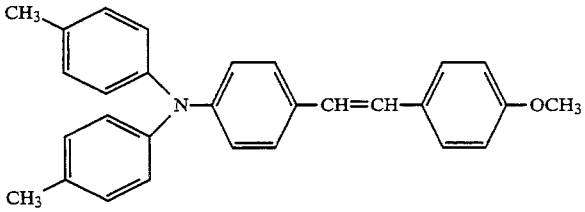
A-(7)
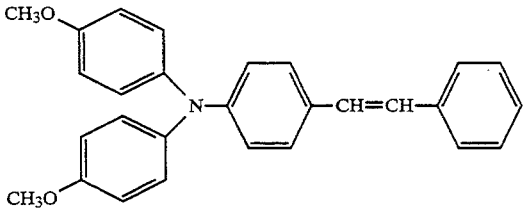
A-(8)
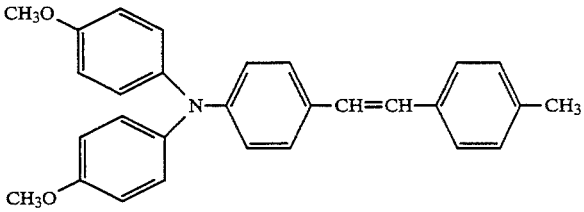
A-(9)
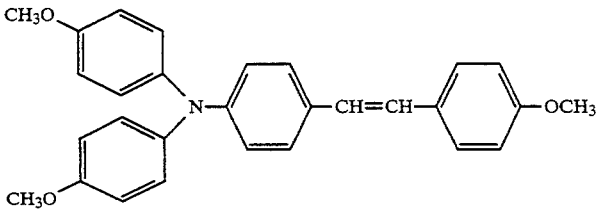

-continued
A-(10)
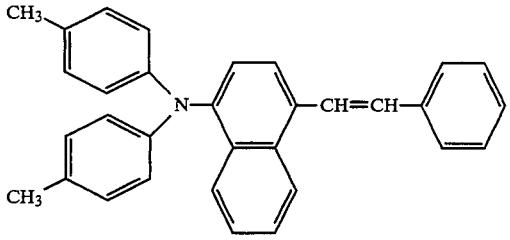
A-(11)
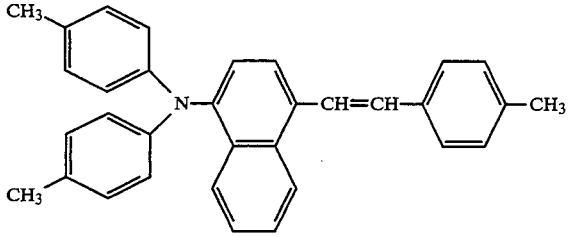
A-(12)
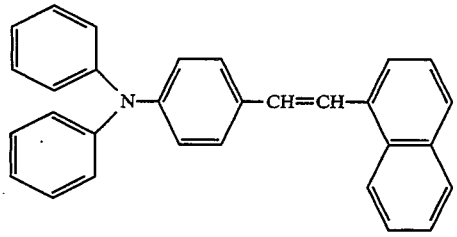
A-(13)
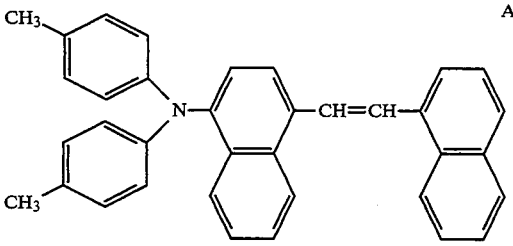
A-(14)
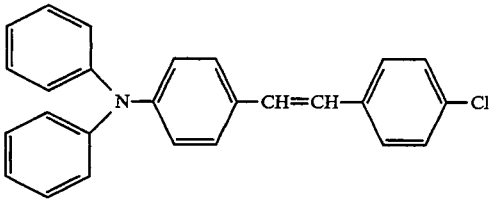
A-(15)
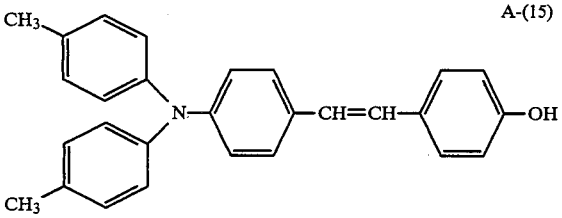
A-(16)
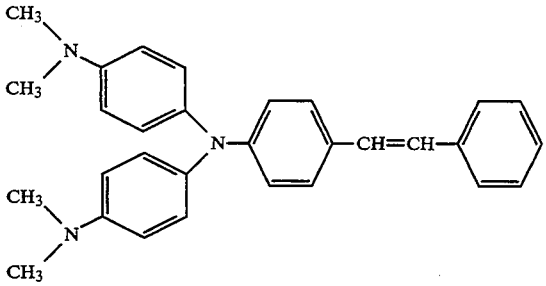
A-(17)
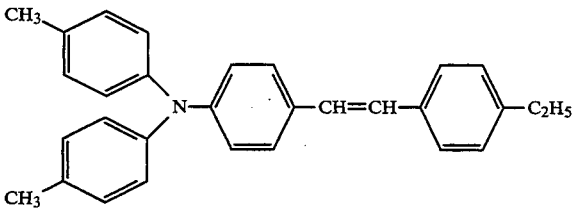

-continued
A-(18)
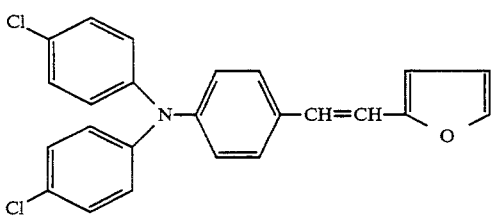
A-(19)
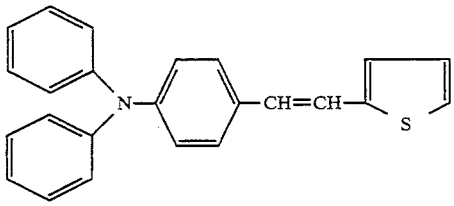
A-(20)
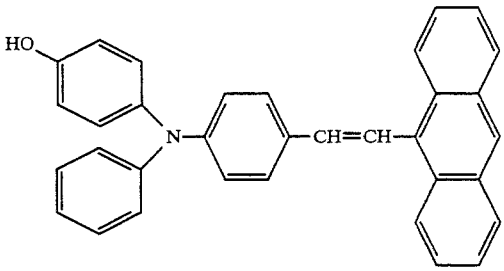
A-(21)
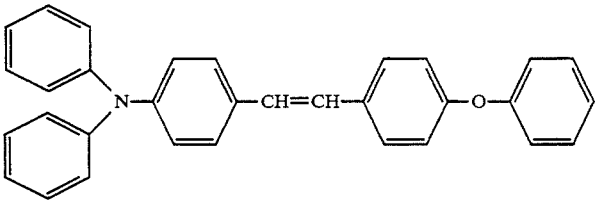
A-(22)
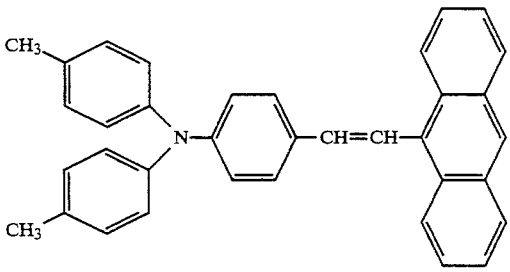
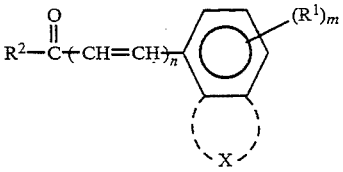
TABLE
| Compound No. | n | $R^2$ | 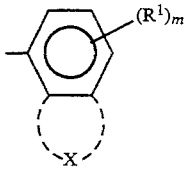 |
|---|---|---|---|
| 1 | 0 | H | 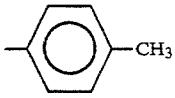 |
| 2 | 0 | H | 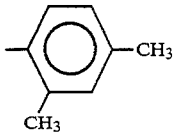 |
| 3 | 0 | H | 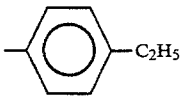 |

TABLE-continued
| Compound No. | n | $R^2$ | 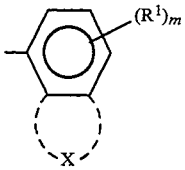 |
|---|---|---|---|
| 4 | 0 | H | 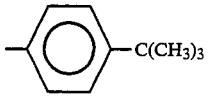 |
| 5 | 0 | H | 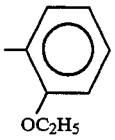 |
| 6 | 0 | H | 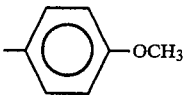 |
| 7 | 0 | H | 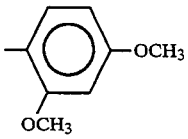 |
| 8 | 0 | H | 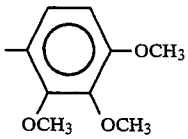 |
| 9 | 0 | H | 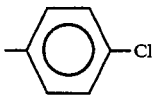 |
| 10 | 0 | H | 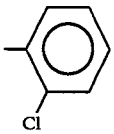 |
| 11 | 0 | H | 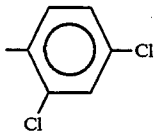 |
| 12 | 1 | H | 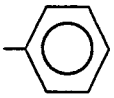 |
| 13 | 1 | H | 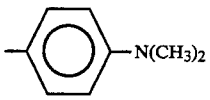 |

TABLE-continued
| Compound No. | n | $R^2$ | 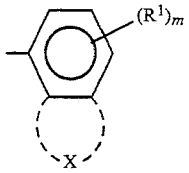 |
|---|---|---|---|
| 14 | 1 | H | 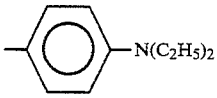 |
| 15 | 1 | H | 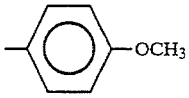 |
| 16 | 1 | H | 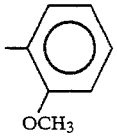 |
| 17 | 0 | H | 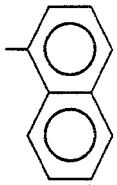 |
| 18 | 0 | H | 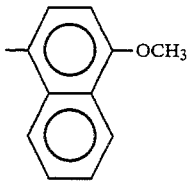 |
| 19 | 0 | H | 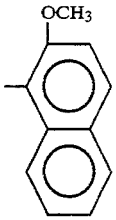 |
| 20 | 0 | H | 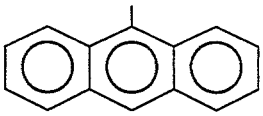 |
| 21 | 0 | H | 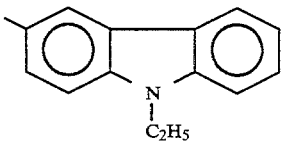 |
| 22 | 0 | H | 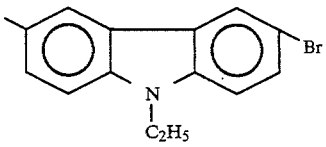 |

TABLE-continued
| Compound No. | n | $R^2$ | 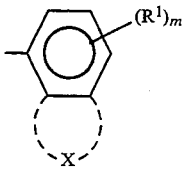 |
|---|---|---|---|
| 23 | 0 | H | 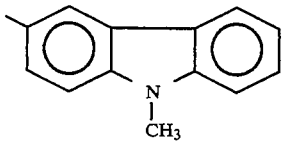 |
| 24 | 0 | H | 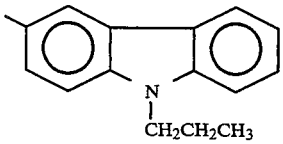 |
| 25 | 0 | H | 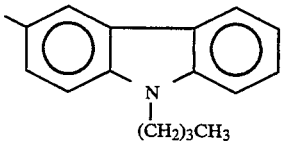 |
| 26 | 0 | 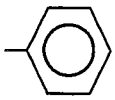 | 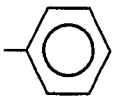 |
| 27 | 0 | 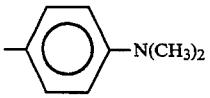 | 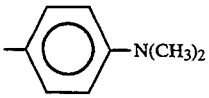 |
| 28 | 0 | 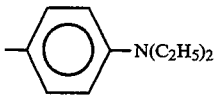 | 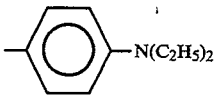 |
| 29 | 0 | H | 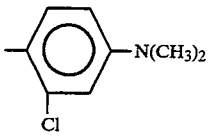 |
| 30 | 0 | H | 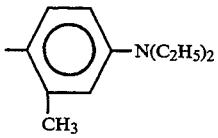 |
| 31 | 0 | H | 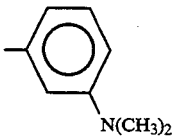 |
| 32 | 0 | H | 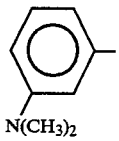 |

TABLE-continued
| Compound No. | n | $R^2$ | 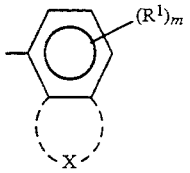 |
|---|---|---|---|
| 33 | 0 | $-CH_3$ | 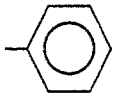 |
| 34 | 0 | $-CH_3$ | 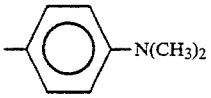 |
| 35 | 0 | H | 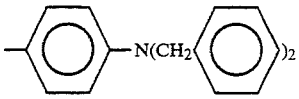 |
| 36 | 0 | H | 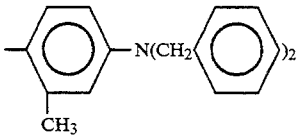 |
| 37 | 0 | H | 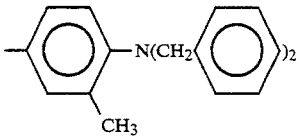 |
| 38 | 0 | H | 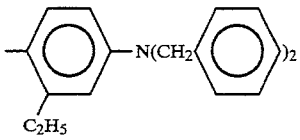 |
| 39 | 0 | H | 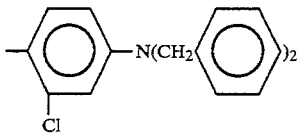 |
| 40 | 0 | H | 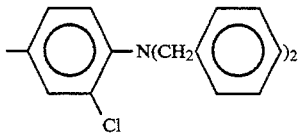 |
| 41 | 0 | H | 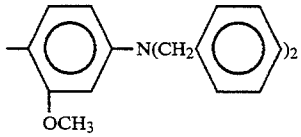 |
| 42 | 0 | H | 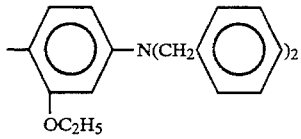 |

TABLE-continued
| Compound No. | n | $R^2$ | 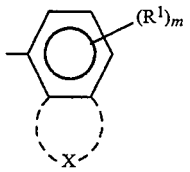 |
|---|---|---|---|
| 43 | 0 | H | 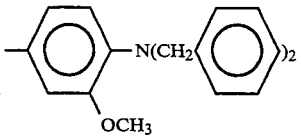 |
| 44 | 0 | H | 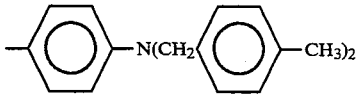 |
| 45 | 0 | H | 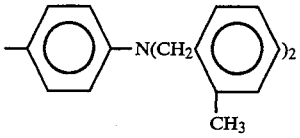 |
| 46 | 0 | H | 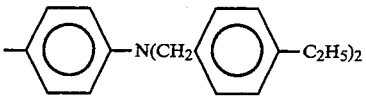 |
| 47 | 0 | H | 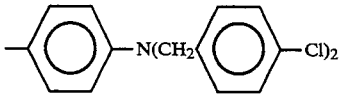 |
| 48 | 0 | H | 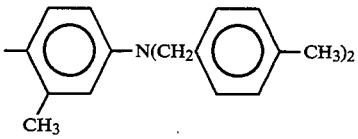 |
| 49 | 0 | H | 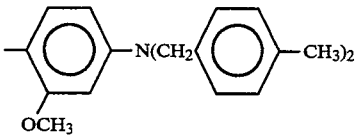 |
| 50 | 0 | H | 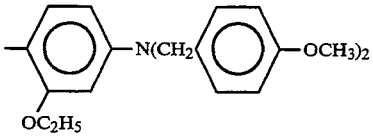 |
| 51 | 0 | H | 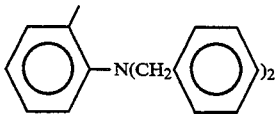 |
| 52 | 0 | H | 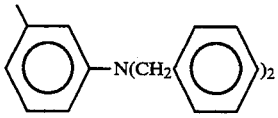 |

TABLE-continued
| Compound No. | n | $R^2$ | 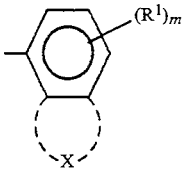 |
|---|---|---|---|
| 53 | 0 | H | 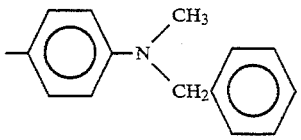 |
| 54 | 0 | H | 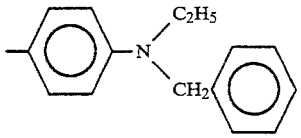 |
| 55 | 0 | H | 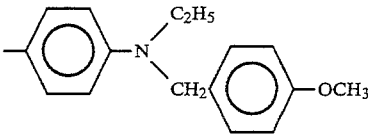 |
| 56 | 0 | H | 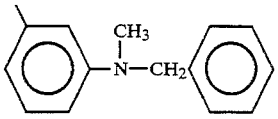 |
| 57 | 0 | H | 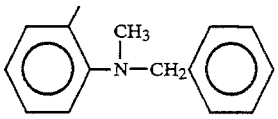 |
| 58 | 0 | H | 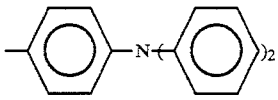 |
| 59 | 0 | H | 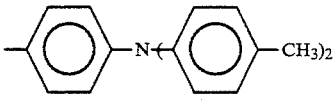 |
| 60 | 0 | H | 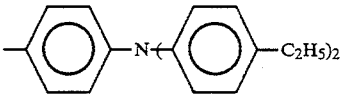 |
| 61 | 0 | H | 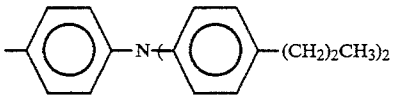 |
| 62 | 0 | H | 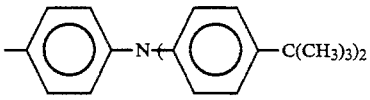 |

TABLE-continued
| Compound No. | n | $R^2$ | 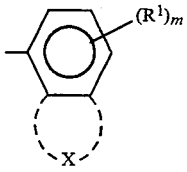 |
|---|---|---|---|
| 63 | 0 | H | 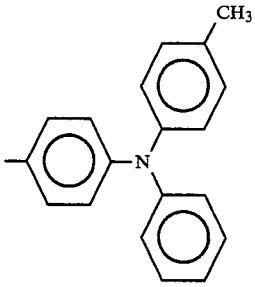 |
| 64 | 0 | H | 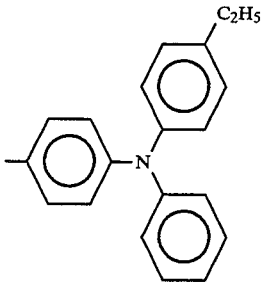 |
| 65 | 0 | H | 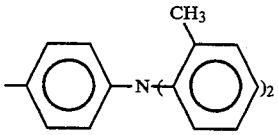 |
| 66 | 0 | H | 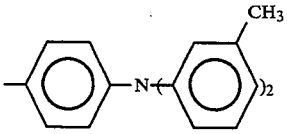 |
| 67 | 0 | H | 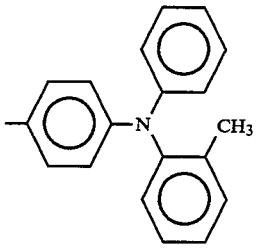 |
| 68 | 0 | H | 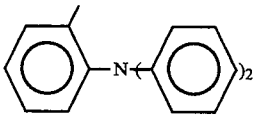 |
| 69 | 0 | H | 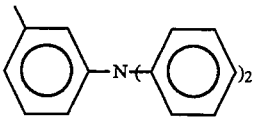 |

TABLE-continued
| Compound No. | n | $R^2$ | 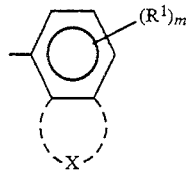 |
|---|---|---|---|
| 70 | 0 | H | 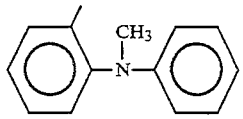 |
| 71 | 0 | H | 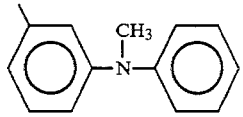 |
| 72 | 0 | H | 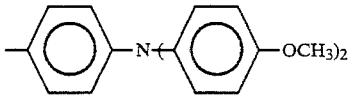 |
| 73 | 0 | H | 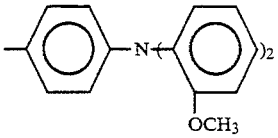 |
| 74 | 0 | H | 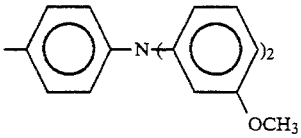 |
| 75 | 0 | H | 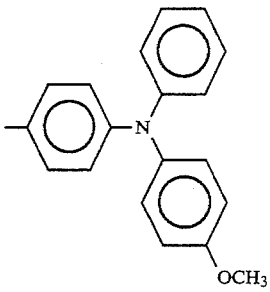 |
| 76 | 0 | H | 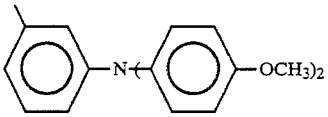 |
| 77 | 0 | H | 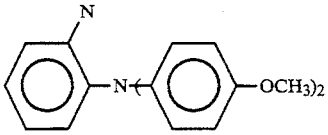 |
| 78 | 0 | H | 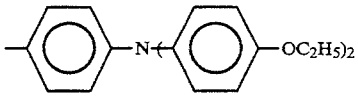 |

TABLE-continued
| Compound No. | n | $R^2$ | 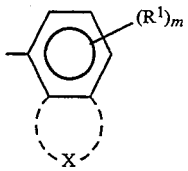 |
|---|---|---|---|
| 79 | 0 | H | 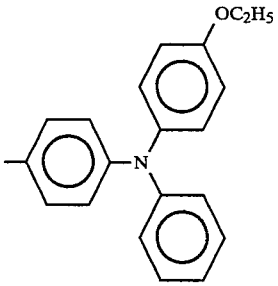 |
| 80 | 0 | H | 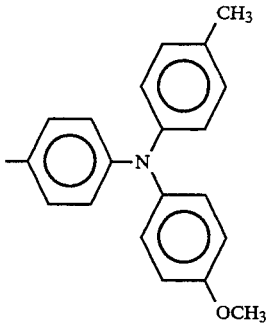 |
| 81 | 0 | H | 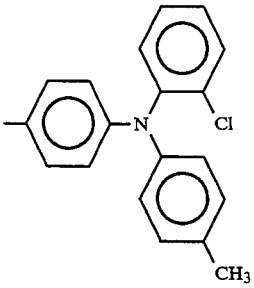 |
| 82 | 0 | H | 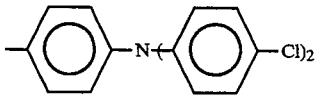 |
| 83 | 0 | H | 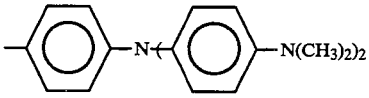 |
| 84 | 0 | H | 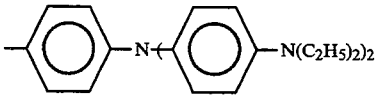 |

TABLE-continued
| Compound No. | n | $R^2$ | 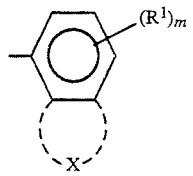 |
|---|---|---|---|
| 85 | 0 | H | 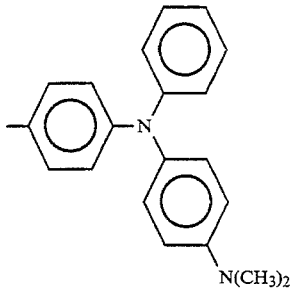 |
| 86 | 0 | H | 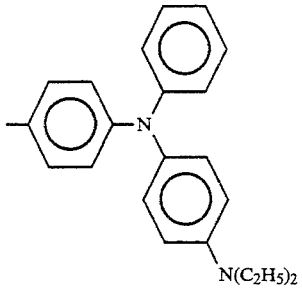 |
| 87 | 0 | H | 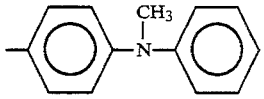 |
| 88 | 0 | H | 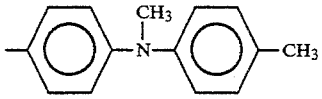 |
| 89 | 0 | H | 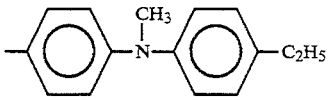 |
| 90 | 0 | H | 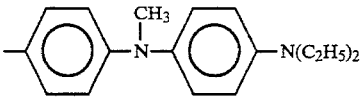 |
| 91 | 0 | H | 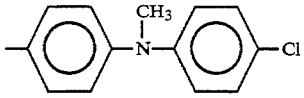 |
| 92 | 0 | H | 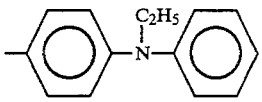 |
| 93 | 0 | H | 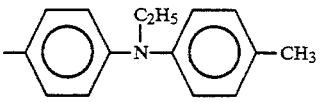 |

TABLE-continued
| Compound No. | n | $R^2$ | 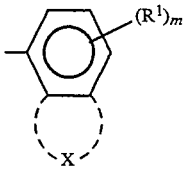 |
|---|---|---|---|
| 94 | 0 | H | 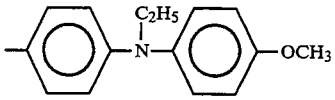 |
| 95 | 0 | H | 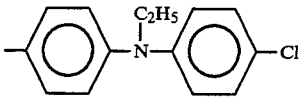 |
| 96 | 0 | H | 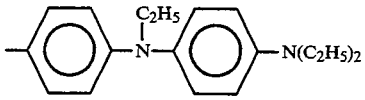 |
| 97 | 0 | H | 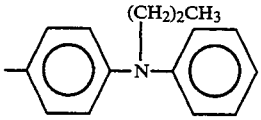 |
| 98 | 0 | H | 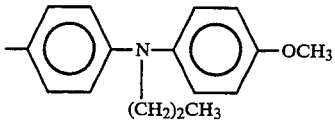 |
| 99 | 0 | H | 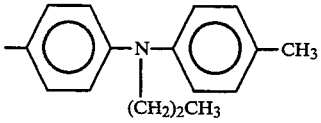 |
| 100 | 0 | H | 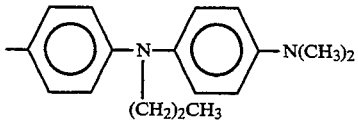 |
| 101 | 0 | H | 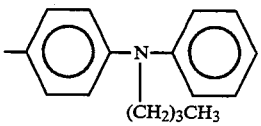 |
| 102 | 0 | H | 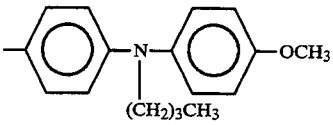 |
| 103 | 0 | H | 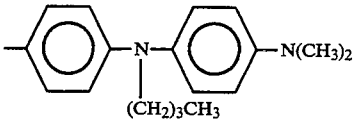 |
| 104 | 0 | H | 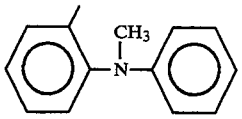 |

TABLE-continued
| Compound No. | n | $R^2$ | 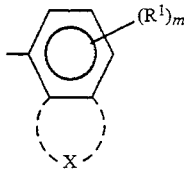 |
|---|---|---|---|
| 105 | 0 | H | 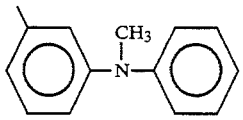 |
| 106 | 0 | H | 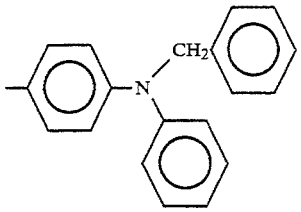 |
| 107 | 0 | H | 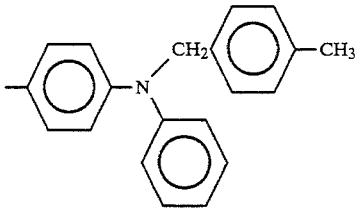 |
| 108 | 0 | H | 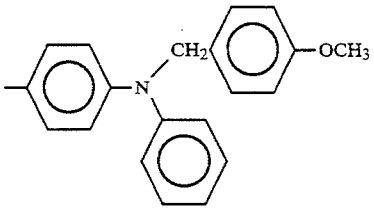 |
| 109 | 0 | H | 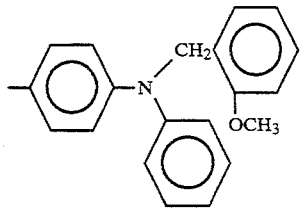 |
| 110 | 0 | H | 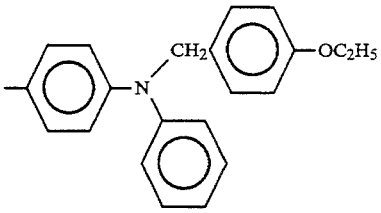 |

TABLE-continued
| Compound No. | n | $R^2$ | 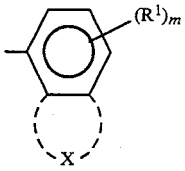 |
|---|---|---|---|
| 111 | 0 | H | 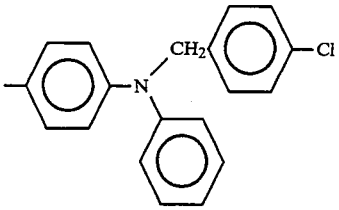 |
| 112 | 0 | H | 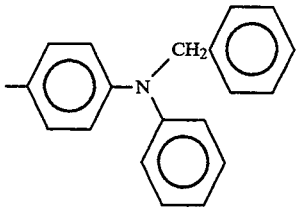 |
| 113 | 0 | H | 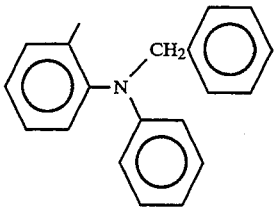 |
| 114 | 0 | H | 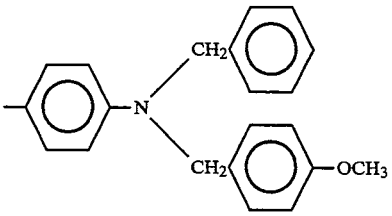 |
| 115 | 0 | H | 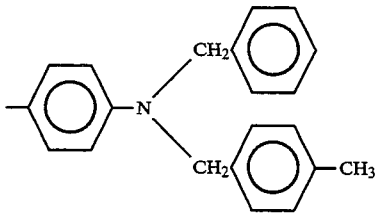 |
| 116 | 0 | H | 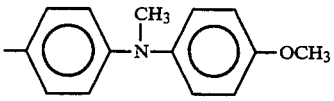 |
| 117 | 0 | H | 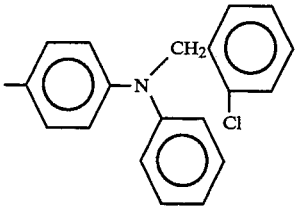 |

TABLE-continued
| Compound No. | n | $R^2$ | 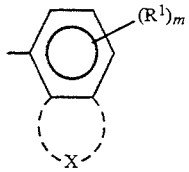 |
|---|---|---|---|
| 118 | 0 | H | 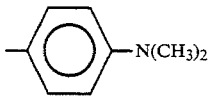 |
| 119 | 0 | H | 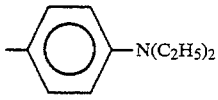 |
| 120 | 0 | H | 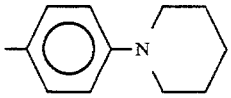 |
| 121 | 0 | H | 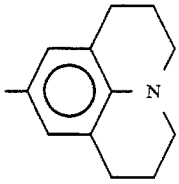 |
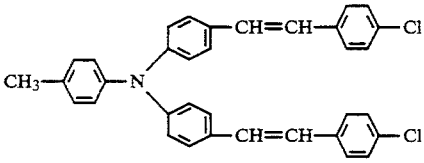
(I-1)
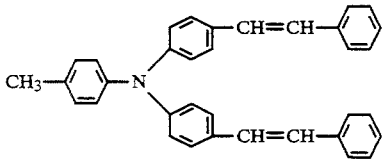
(I-2)
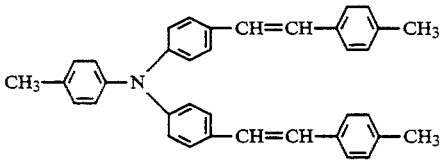
(I-3)
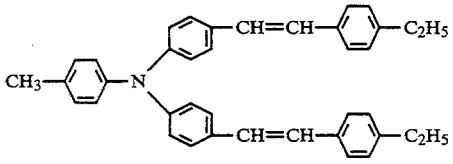
(I-4)
-continued
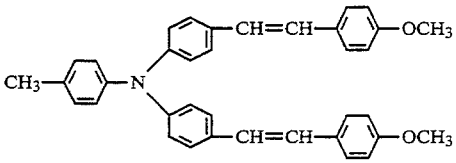
(I-5)
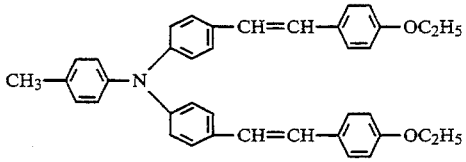
(I-6)
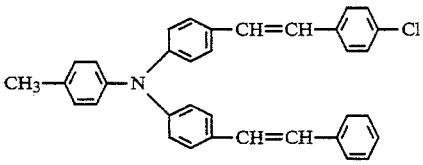
(I-7)
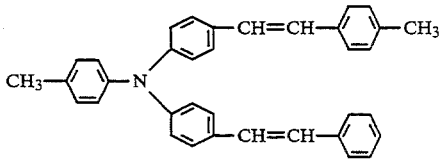
(I-8)

-continued
(I-9)
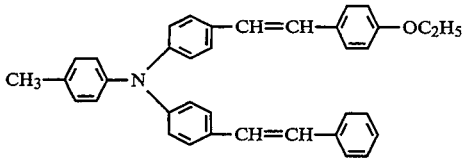
(I-10)
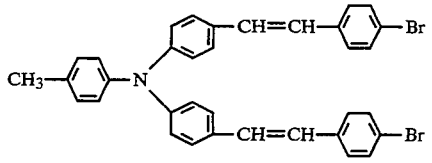
(I-11)
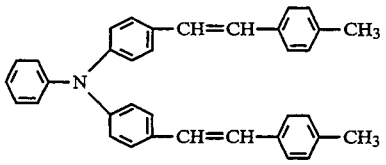
(I-12)
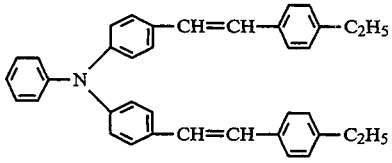
(I-13)
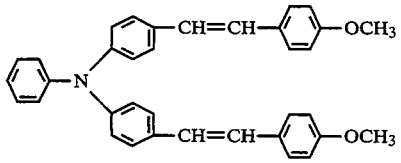
(I-14)
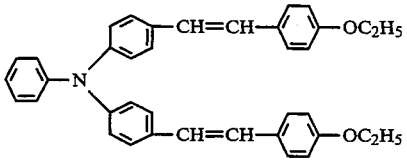
(I-15)
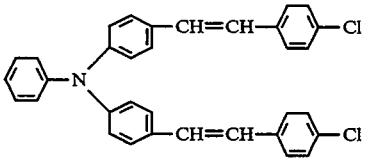
(I-16)
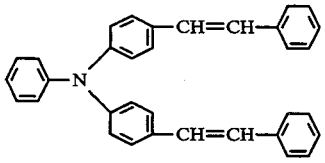
(I-17)
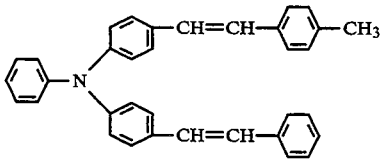
-continued
(I-18)
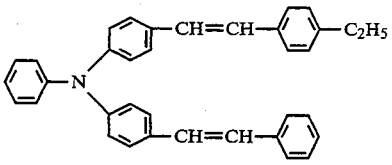
(I-19)
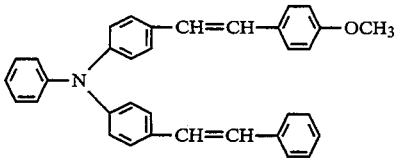
(I-20)
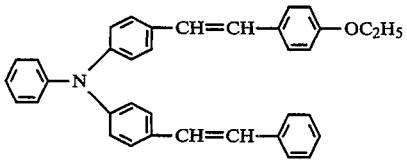
(I-21)
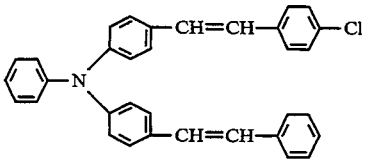
(I-22)
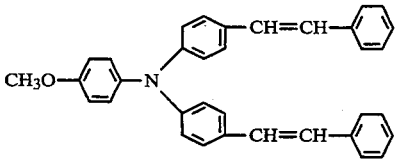
(I-23)
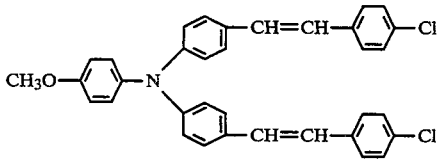
(I-24)
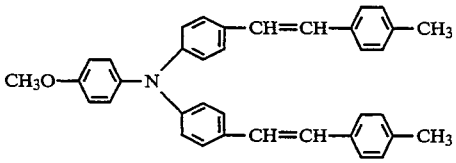
(I-25)
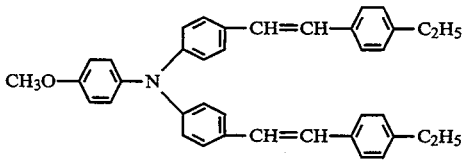
(I-26)
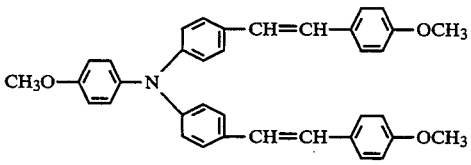

-continued
(I-27)
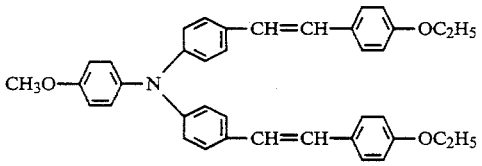
(I-28)
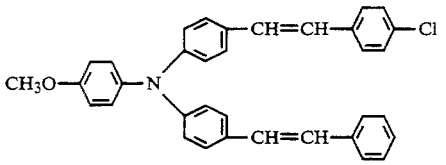
(I-29)
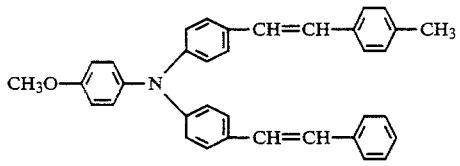
(I-30)
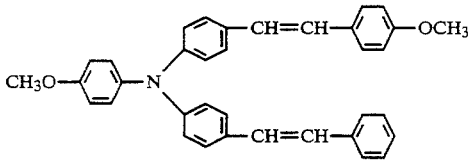
(I-31)
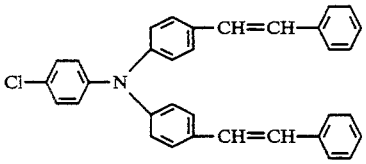
(I-32)
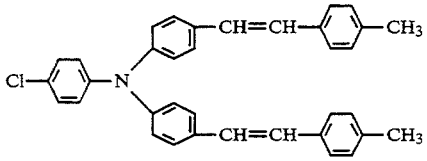
(I-32)
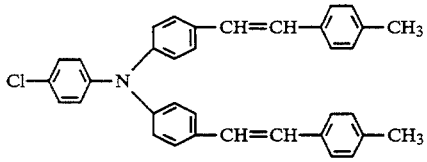
(I-33)
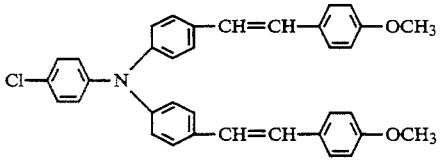
(I-34)
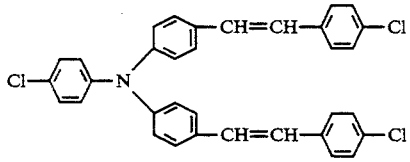
-continued
(I-35)
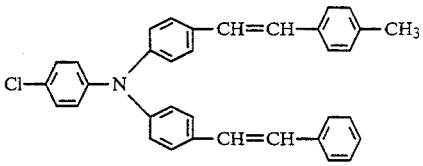
(I-36)
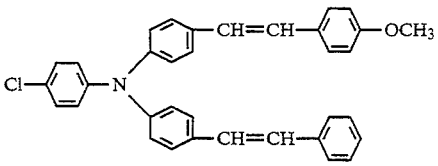
(I-37)
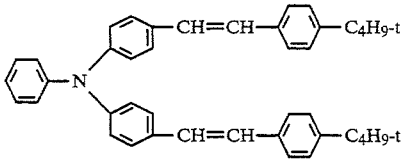
(I-38)
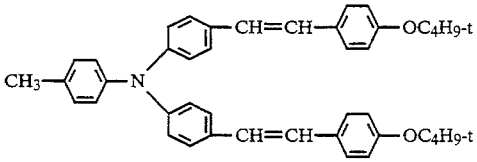
(I-39)
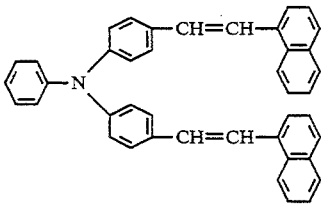
(I-40)
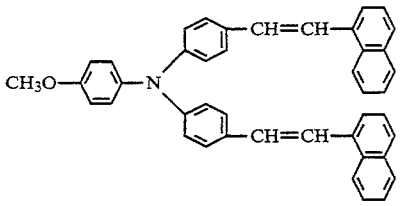
(I-41)
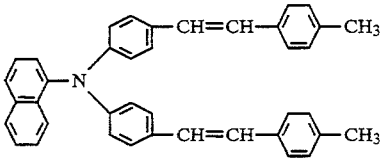
(I-42)
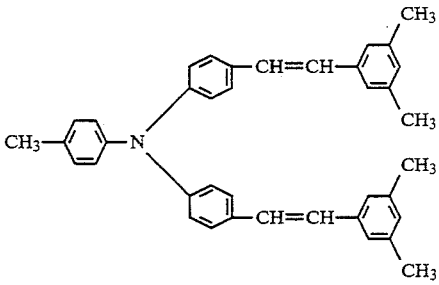

-continued
(I-43)
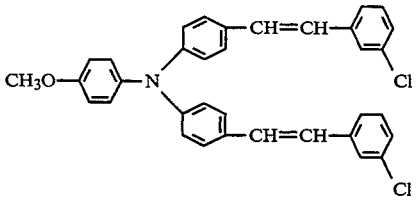
(I-44)
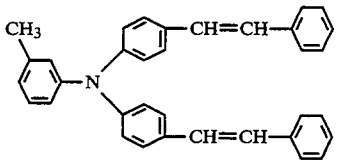
(I-45)
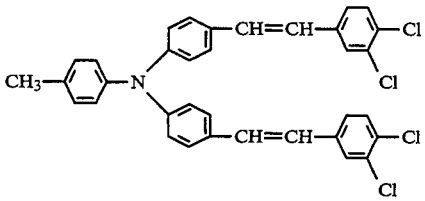
(I-46)
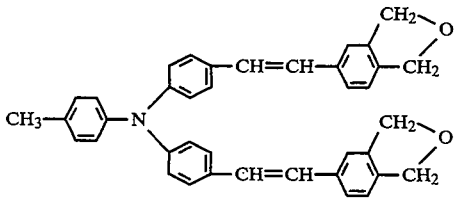
(I-47)
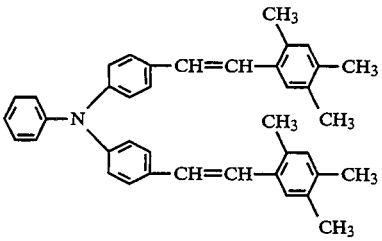
(I-48)
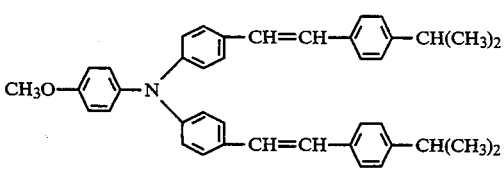
(I-49)
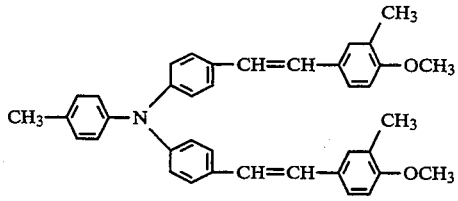
(I-50)
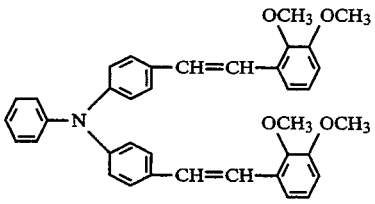
-continued
(I-51)
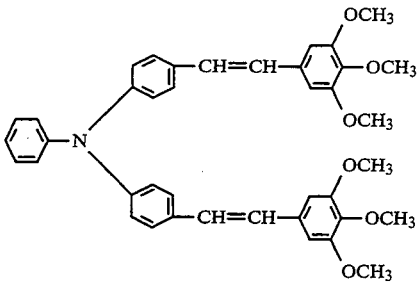
(I-52)
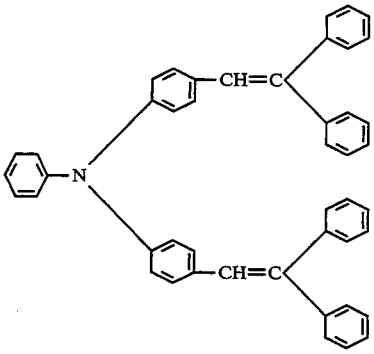
(I-53)
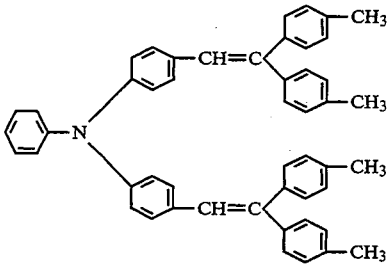
(I-54)
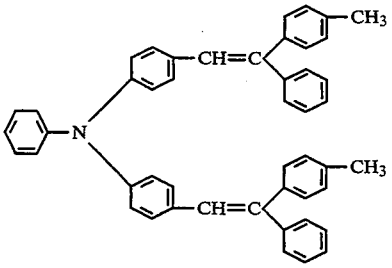
(I-55)
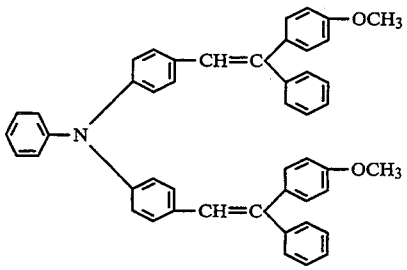

-continued
(I-56)
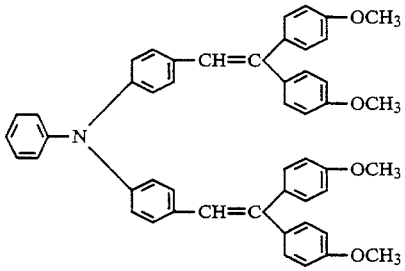
(I-57)
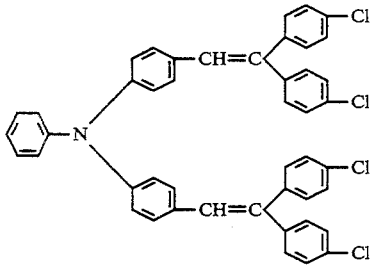
(I-58)
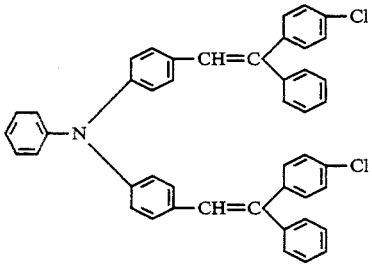
(I-59)
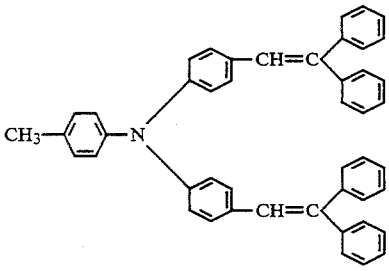
(I-60)
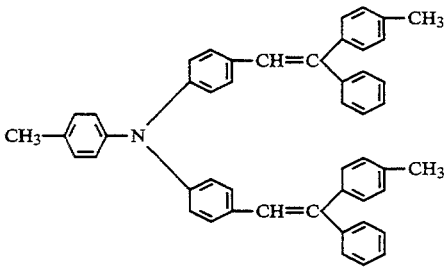
-continued
(I-61)
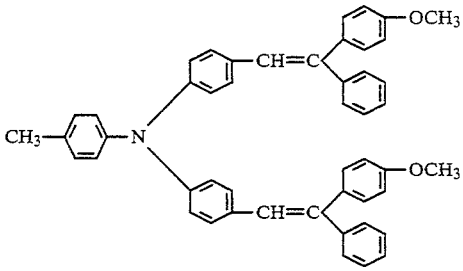
(I-62)
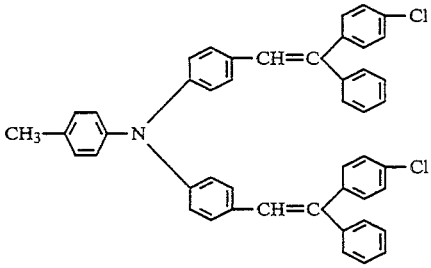
(I-63)
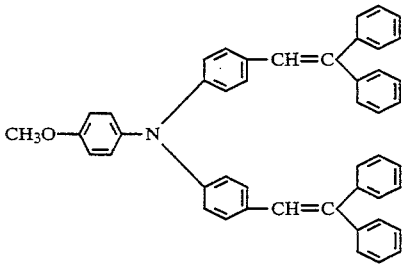
(I-64)
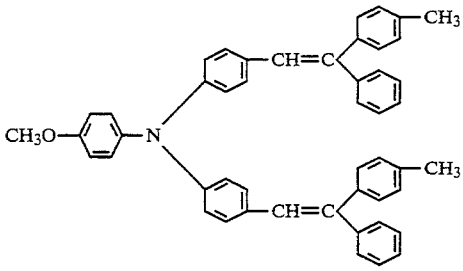
(I-65)
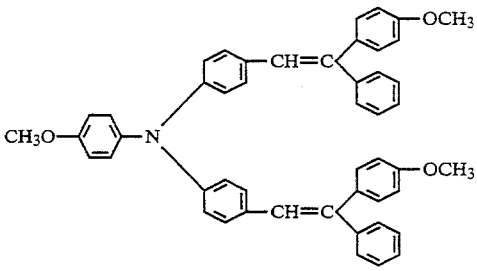

-continued (I-66)

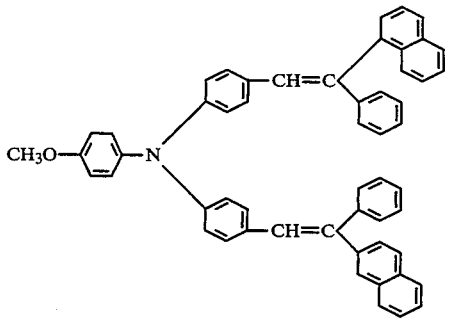

(I-67)

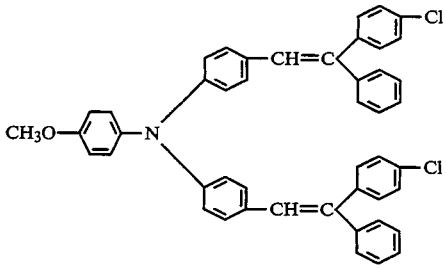

(I-68)

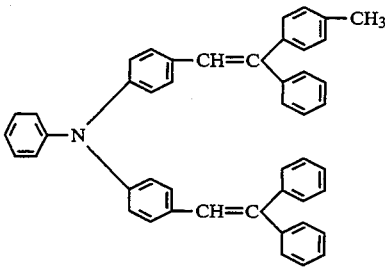

(I-69)

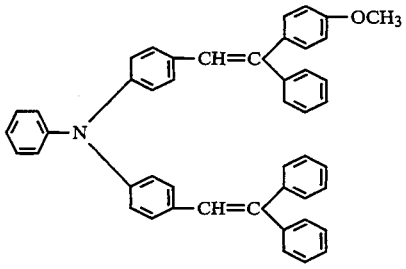

(I-70)

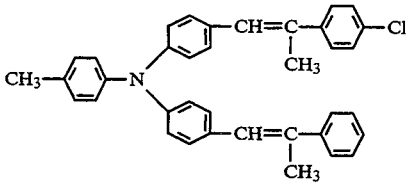

(I-71)

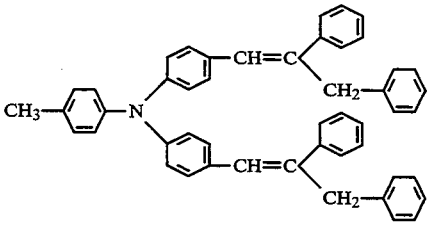

-continued (I-72)

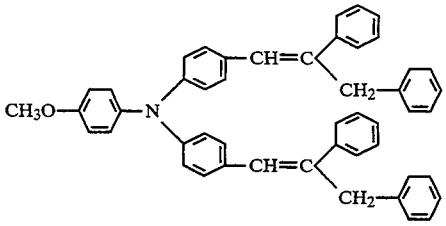

(I-73)

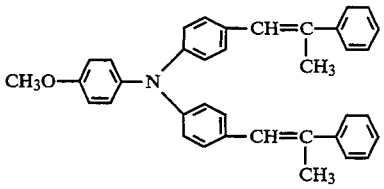

(I-74)

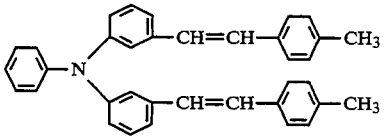

(I-75)

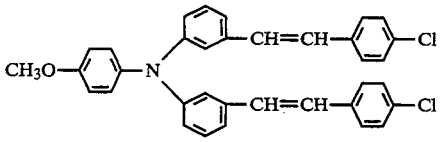

(I-76)

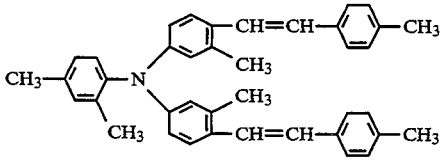

(I-77)

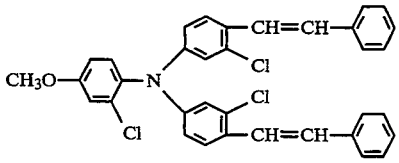

As resins for forming an intermediate layer in the present invention, in addition to the above-mentioned resins, for example, polyurethane resin
polyamide resin
polyvinyl alcohol
epoxy resin
ethylene-acrylic acid copolymer
ethylene-vinyl acetate copolymer
casein
methylcellulose
nitrocellulose
alkyd resin are employed.

The above-mentioned binders can be employed singly or two or more of them can be used as a mixture.

Of them, the especially preferable is a polyamide resin.

The above-mentioned polyamide resin can be dissolved into alcohols such as methanol, ethanol and butanol.

The thickness of intermediate layer is preferably 0.01 to 5 μm.

In order to increase sensitivity and decrease fatigue caused by residual potential and by repeated use, one or more kinds of electron-accepting materials can be incorporated into the CGL in the present invention.

As electron-accepting material capable of being employed here, for example, succinate anhydride, maleic acid anhydride, dibrommomaleic acid anhydride, phthalic acid anhydride, tetrachlorophthalic acid anhydride, tetrabromophthalic acid anhydride, 3-nitro phthalic acid anhydride, 4-nitro phthalic acid anhydride, pyrromellitic acid anhydride, mellitic acid anhydride, tetracyanoethylene, tetracyanoquinodimethane, o-dinitrobenzene, m-dinitrobenzene, 1,3,5-trinitrobenzene, paranitrobenzonitrile, picryl chloride, quinonechloroimide, chloranyl, bromanyl, dichlorodicyanoparabenzoquinone, anthraquinone, dinitroanthraquinone, 2,7-dinitrofluorenone, 2,4,7-trinitrofluorenone, 2,4,5,7-tetranitrofluorenone, 9-fluorenilidene[dicyanomethylenemalonodinitrile], polynitro-9-fluorenilidene-[dicyanomethylenemalonodinitrile], picric acid, o-nitrobenzoic acid, p-nitrobenzoic acid, 3,5-di-nitrobenzoic acid, pentafluorobenzoic acid, 5-nitrosalicylic acid, 3,5-dinitrosalicylic acid, phthalic acid, mellitic acid and other compounds having high electron affinity are cited.

The added amount of electron-accepting material can be expressed as follows:

a carrier generated material:an electron-accepting material is 100:0.01 to 200 by weight and preferably 100:0.1 to 100.

The electron-accepting material may be added to a CTL. The added amount of electron-accepting material to said layer can be expressed as follows:

CTM:an electron-receiving material is 100:0.01 to 100 and preferably 100:0.1 to 50.

In addition, to a photoreceptor in the present invention, a UV absorber and the like can be incorporated in order to protect a photoreceptive layer. Furthermore, a dye for correcting color sensitivity can be incorporated.

To a photoreceptive layer in the present invention, organic amines can be added in order to improve a function for generating carrier of CGM. It is especially preferable to add secondary amines.

As the above-mentioned secondary amines, for example, dimethylamine, diethylamine, dipropylamine, diisopropylamine, dibutylamine, diisobutylamine, diamylamine, diisoamylamine, dihexylamine, diisohexylamine, dipentylamine, diisopentylamine, dioctylamine, diisooctylamine, dinonylamine, diisononylamine, didecylamine, diisodecylamine, dimonodecylamine, diisomonodecylamine, didodecylamine and diisododecylamine are cited.

In addition, the added amount of the above-mentioned organic amines is allowed to be not more than equivalent to CGM. It is preferably 0.2 to 0.005 time of mol number of CGM.

In addition, to a photoreceptive layer in the present invention, an anti-oxidation agent can be added in order to prevent deterioration of ozone.

Typical examples of the above-mentioned anti-oxidation agent are illustrated as follows. However, the present invention is not limited thereto.

Group I; Hindered phenols, Group II; Paraphenylenediamines, Group III; Hydroquinones, Group IV; Organic sulfur compounds, Group V; Organic phosphor compounds.

are cited.

The above-mentioned compounds are, for example, disclosed in Japanese Patent O.P.I. Publication No. 18354/1988.

The above-mentioned compounds are known as anti-oxidation agents for rubbers, plastics and fats and oils. They are easily available in the market.

The added amount of anti-oxidation agent is 0.1 to 100 parts by weight, preferably 1 to 50 parts by weight and more preferably 5 to 25 parts by weights per 100 parts by weight of CTM.

As a electroconductive support employed in an electrophotographic photoreceptor in the present invention, there are cited metal plates and metal drums including their alloy or electroconductive papers and plastic films wherein electroconductive compounds such as electroconductive polymers and indium oxide and metals such as aluminum, palladium and gold and alloys thereof have been coated, deposited or laminated thereon. As an intermediate layer including an adhesive layer or a barrier layer, organic polymer materials such as polyvinyl alcohol, ethylcellulose and carboxymethylcellulose in addition to the above-mentioned high molecule polymers employed as binder resins or aluminium oxide are employed.

EXAMPLES

The present invention is hereinafter described in more detail by means of the following examples, which are not to be construed as limitative on the embodiment of the invention.

Example 1

To a mixed solvent of 900 ml of methanol and 100 ml of 1-buthanol, 30 g of polyamide resin CM-8000 (produced by TORAY) was poured. The solution was heated and dissolved at 50 ° C. The solution was coated onto an aluminium drum having an outside diameter of 80 mm and a length of 355 mm through dipping coating to form an intermediate layer having thickness of 0.5 μm.

Next, 5 g of Eslec BM-S, polyvinyl butyral resin, (produced by Sekisui Chemicals Co., Ltd) was dissolved into 1000 ml of methylisobutylketone (MIBK), to which 10 g of an exemplified compound (F-1) was mixed as a CGM. The solution was dispersed for 10 hours in a sand mill. This solution was coated onto the above-mentioned intermediate layer through dipping coating to form a CGL having thickness of 0.3 μm.

Next, 200 g of the below-mentioned compound ($T_1$-1) as a CTM and 200 g of Yupilon Z-200 (produced by Mitsubishi Gas Chemical Co. Ltd.), polycarbonate resin, were dissolved into 1000 ml of 1,2-dichloroethane (EDC). This solution was coated onto the above-mentioned CGL through dipping coating. Then, it was dried for 1 hour at 100 ° C. to form a CTL having thickness of 20 μm. Thus, a laminated photoreceptor composed of an intermediate layer, a CGL and a CTL was obtained.

Example 2

A photoreceptor was prepared in the same manner as in Example 1 except that isopropyl acetate (IPAc) was used as a CGL solvent.

Example 3

A photoreceptor was prepared in the same manner as in Example 1 except that secondary butyl acetate (sec-BAc) was employed as a CGL solvent.

Example 4

A photoreceptor was prepared in the same manner as in Example 1 except that an exemplified compound (F-23) was employed as a CGM.

Example 5

A photoreceptor was prepared in the same manner as in Example 4 except that tertial butyl acetate (TBAc) was employed as a CGL solvent and Eslec BX-1 (produced by Sekisui Chemicals Co., Ltd.), polyvinyl butyral resin, was employed as a CGL binder.

Example 6

A photoreceptor was prepared in the same manner as in Example 5 except that isopropyl alcohol was employed as a CGL solvent.

Example 7

A photoreceptor was prepared in the same manner as in Example 5 except that methylisopropylketone (MIPK) was employed as a CGL solvent.

Comparative example (1)

A photoreceptor was prepared in the same manner as in Example 1 except that cyclohexanone was employed as a CGL solvent and the CGL binder was removed.

Comparative example (2)

A photoreceptor was prepared in the same manner as in Example 5 except that methylethylketone (MEK) was employed as a CGL solvent.

Comparative sample (3)

A photoreceptor was prepared in the same manner as in Example 5 except that an EDC was employed as a CGL solvent.

Comparative example (4)

A photoreceptor was prepared in the same manner as in Example 7 except that the following compound A-1 was employed as a CGM.

Table 1 shows the components of the above-mentioned samples.

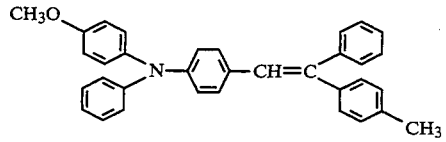

T1-1

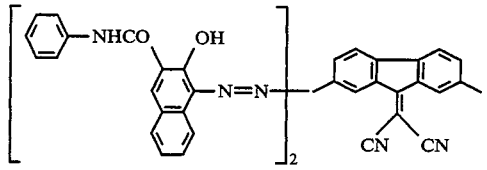

A-1

| Sample No. | CGM | CGL solvent | CGL binder |
|---|---|---|---|
| 1 | F-1 | MIBK | BM-S |
| 2 | F-1 | IPAc | BM-S |
| 3 | F-1 | sec-BAc | BM-S |
| 4 | F-23 | MIBK | BM-S |
| 5 | F-23 | TBAc | BX-1 |
| 6 | F-23 | isopropyl alcohol | BX-1 |
| 7 | F-23 | MIPK | BX-1 |
| Comparative (1) | F-1 | cyclohexanone | — |
| Comparative (2) | F-23 | MEK | BX-1 |
| Comparative (3) | F-23 | EDC | BX-1 |
| Comparative (4) | A-1 | MIPK | BX-1 |

Performance evaluation of photoreceptors

Each of the photoreceptors obtained Examples 1 to 7 and Comparative examples (1) to (4) was attached on "U-Bix 3035" (produced by Konica), and their surface potentials $V_w$ for a document with a reflection density of 0.0 were measured.

In addition, the above-mentioned CGL solution was coated on a PET base employing a wire bar, and the light absorbance spectrum of the CGL was measured employing "Self-recording type spectral photometer" produced by Hitachi Ltd.

The following ratio of light absorption between the first peak and the second peak of the CGL to be measured here was read.

*Ratio of light absorption=light absorption of the first peak/light absorption of the second peak*

Next, photoreceptor samples after the above-mentioned CGL solution was coated onto 10,000 pcs and photoreceptor samples wherein the above-mentioned solution was coated after being left for 1 month in a darkroom at 20 ° C. were prepared. Then, they were subjected to the same evaluation as above.

Results of the evaluation are shown in Table 2.

TABLE 2

| | Vw | | | Ratio of absorbance | | |
|---|---|---|---|---|---|---|
| Sample No. | Initial | After coating 10,000 pcs | After one month | Initial | After coating 10,000 PCs | After one month |
| Sample 1 | −95 | −98 | −98 | 1.40 | 1.39 | 1.39 |
| Sample 2 | −100 | −101 | −102 | 1.41 | 1.39 | 1.40 |
| Sample 3 | −98 | −100 | −102 | 1.41 | 1.40 | 1.39 |
| Sample 4 | −93 | −95 | −96 | 1.08 | 1.06 | 1.06 |
| Sample 5 | −95 | −99 | −100 | 1.09 | 1.08 | 1.07 |
| Sample 6 | −100 | −105 | −105 | 1.07 | 1.07 | 1.05 |
| Sample 7 | −80 | −80 | −81 | 1.08 | 1.08 | 1.08 |
| Comparative (1) | −75 | −80 | −153 | 1.41 | 1.40 | 1.15 |
| Comparative (2) | −80 | −132 | −184 | 1.07 | 1.00 | 0.90 |
| Comparative (3) | −92 | −148 | −200 | 1.08 | 0.95 | 0.80 |

TABLE 2-continued

| Sample No. | Vw Initial | Vw After coating 10,000 pcs | Vw After one month | Ratio of absorbance Initial | Ratio of absorbance After coating 10,000 PCs | Ratio of absorbance After one month |
|---|---|---|---|---|---|---|
| Comparative (4) | −100 | −151 | −195 | 1.21 | 1.05 | 0.93 |

As is apparent from the table, compared with comparative samples, the sample of the present invention in terms of Vw and light absorption is not influenced by a consumption manner wherein fatigue of fluid dynamics type and rheologic type of CGL solution caused by repetitive immersing consumption are accumulated, and can keep stability through long-term preservation.

What is claimed is:

1. A method for preparing an electrophotographic photoreceptor comprising the steps of:

(a) preparing a dispersion solution comprising a carrier generation material, a polyvinyl butyral binder resin, and an organic solvent; and (b) coating said dispersion solution on a conductive support;

wherein said carrier generation material is a fluorenone bisazo pigment represented by Formula $F_1$, and a main component of said organic solvent is selected from the group consisting of a ketone solvent, an ester solvent, and an alcohol, each having a branched alkyl substituent;

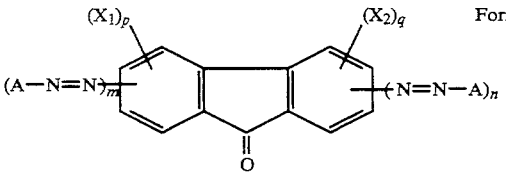

Formula $F_1$ wherein $X_1$ and $X_2$ each represent halogen, alkyl, alkoxy, nitro, cyano, hydroxyl, or a substituted or unsubstituted amino, p and q each represent 0 or an integer of 1 or 2; wherein when p and q are 2, $X_1$ and $X_2$ may be either the same or different, and A is a group represented by Formula $F_1$-1:

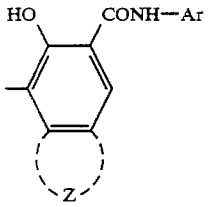

Formula $F_1$-1 wherein Ar represents a substituted aromatic cyclic hydrocarbon or a substituted aromatic heterocyclic, Z represents a non-metal atom group necessary to form a substituted or unsubstituted aromatic cyclic hydrocarbon, a substituted aromatic heterocyclic, or an unsubstituted aromatic heterocyclic, and m and n each represent 0 or an integer of 1 or 2, provided that both m and n cannot be 0 at the same time.

2. The method of claim 1, wherein said solvent is methylisopropylketone.

3. The method of claim 1, wherein said electrophotographic photoreceptor further comprising an intermediate layer, and said intermediate layer is formed with an intermediate layer binder selected from the group consisting of polyurethane resin, polyamide resin, polyvinyl alcohol, epoxy resin, ethylene-acrylic acid copolymer, ethylene-vinyl acetate copolymer, casein, methyl cellulose, nitrocellulose and alkyd resin.

4. The method of claim 3, wherein said binder is polyamide resin.

5. A method for preparing an electrophotographic photoreceptor comprising the steps of:

(a) preparing a dispersion solution comprising a carrier generation material, a polyvinyl butyral resin and methylisopropylketone; and (b) coating said dispersion solution on a conductive support;

wherein said carrier generation material is a fluorenone bisazo pigment represented by Formula $F_1$, and a main component of said organic solvent is selected from the group consisting of ketone solvents, ester solvents, and alcohols, each having a branched alkyl substituent, the degree of butyralization of said polyvinyl butyral being 50 mol % or more:

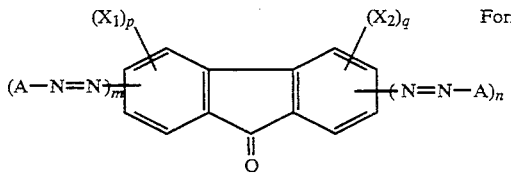

Formula $F_1$ wherein $X_1$ and $X_2$ each represent halogen, alkyl, alkoxy, nitro, cyano, hydroxyl, or a substituted or unsubstituted amino, p and q each represent 0 or an integer of 1 or 2; wherein when p and q are 2, $X_1$ and $X_2$ may be either the same or different, and A is a group represented by Formula $F_1$-1:

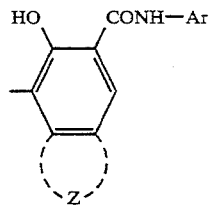

Formula $F_1$-1 wherein Ar represents a substituted aromatic cyclic hydrocarbon or a substituted aromatic heterocyclic, Z represents a non-metal atom group necessary to form a substituted or unsubstituted aromatic cyclic hydrocarbon, a substituted aromatic heterocyclic, or an unsubstituted aromatic heterocyclic, and m and n each represent 0 or an integer of 1 or 2, provided that both m and n cannot be 0 at the same time.

* * * * *